US010100508B1

(12) United States Patent
Fox

(10) Patent No.: US 10,100,508 B1
(45) Date of Patent: Oct. 16, 2018

(54) RAFTER BRACKET

(71) Applicant: FOX HARDWOOD LUMBER COMPANY, L.L.C., Franklin, TN (US)

(72) Inventor: Samuel Fox, Franklin, TN (US)

(73) Assignee: Fox Hardwood Lumber, L.L.C., Franklin, TN (US)

( * ) Notice: Subject to any disclaimer, the term of this patent is extended or adjusted under 35 U.S.C. 154(b) by 0 days.

(21) Appl. No.: 15/912,203

(22) Filed: Mar. 5, 2018

(51) Int. Cl.
*E04B 1/26* (2006.01)
*E04B 7/04* (2006.01)
*E04B 7/06* (2006.01)

(52) U.S. Cl.
CPC ..... *E04B 1/2608* (2013.01); *E04B 7/045* (2013.01); *E04B 7/063* (2013.01); *E04B 2001/2644* (2013.01)

(58) Field of Classification Search
CPC ..... E04B 1/2608; E04B 7/045; E04B 7/063; E04B 2001/2644; E04B 1/4114; E04B 1/40
See application file for complete search history.

(56) References Cited

U.S. PATENT DOCUMENTS 963,585 A * 7/1910 Kimball ..... F16B 12/2009 403/231
1,848,085 A * 3/1932 Eisenschmidt ..... E04G 7/02 249/219.1
4,924,648 A * 5/1990 Gilb ..... E04B 1/41 52/295
7,316,098 B1 * 1/2008 Sackett ..... E04B 7/045 52/712
7,454,872 B2 * 11/2008 Cutforth ..... E02D 27/16 52/295
D703,029 S * 4/2014 Fox ..... D8/373
8,864,096 B1 10/2014 Fox
9,297,161 B2 * 3/2016 Zimmerman ..... E04B 7/045
9,428,902 B1 * 8/2016 LoFranco ..... E04B 1/40
D775,512 S * 1/2017 White ..... D8/354
9,938,745 B1 * 4/2018 Fox ..... E04H 12/2292
10,060,150 * 8/2018 Fox ..... E04H 12/2292
2006/0150564 A1 * 7/2006 Dufault ..... E04B 7/045 52/702
2008/0282641 A1 * 11/2008 Sackett ..... E04B 7/045 52/715

(Continued)

OTHER PUBLICATIONS

Design U.S. Appl. No. 29/639,284, filed Mar. 5, 2018, filed by same Applicant as instant application.

*Primary Examiner* — Rodney Mintz
(74) *Attorney, Agent, or Firm* — Shane Cortesi

(57) ABSTRACT

A rafter bracket configured to connect a vertical post to a rafter is described herein. The rafter bracket may include lower vertical side plates, a horizontal plate, and upper vertical side plates. The horizontal plate may be perpendicular to the upper and lower vertical side plates and may separate the upper vertical side plates from the lower vertical side plates. The horizontal plate and lower vertical side plates may create an upper cavity that receives the vertical post. Meanwhile, the rafter may be positioned on one of the upper vertical side plates and positioned between two of the upper vertical side plates and may be angled at an acute angle relative to the vertical post as well as the upper and lower vertical side plates.

25 Claims, 5 Drawing Sheets

(56) References Cited

U.S. PATENT DOCUMENTS

| | | | | |
|---|---|---|---|---|
| 2009/0178362 | A1* | 7/2009 | Jerke | E04H 9/14 52/656.9 |
| 2013/0067851 | A1* | 3/2013 | Zimmerman | E04B 7/045 52/707 |
| 2015/0096165 | A1* | 4/2015 | Hutchinson | E04B 1/185 29/525.01 |
| 2016/0168840 | A1* | 6/2016 | Monty | E04B 1/26 52/262 |
| 2016/0177560 | A1* | 6/2016 | Hensen | E04B 1/2608 52/272 |
| 2016/0333570 | A1* | 11/2016 | Gueli | E04B 1/2612 |
| 2017/0298612 | A1* | 10/2017 | Hildestad | E04D 12/008 |

* cited by examiner

RAFTER BRACKET

BACKGROUND

Technical Field

The present invention relates to building materials, more particularly, brackets for connecting a wooden post to a rafter for use in a post and beam and timber frame construction.

Background of the Invention

In light frame construction, a birdsmouth joint, also known as a bird's beak cut, is a woodworking joint that is generally used to connect a roof rafter to the top plate of a vertical post (such as a wall stud). The birdsmouth joint is an indentation cut into the rafter which consists of a "seat cut" (the face of which rests on the top plate) and a "heel cut" or "plumb cut" (the face of which lies parallel to the supporting wall), forming a shape resembling a bird's mouth. Generally, the indentation should not extend unsupported on the interior in order to maintain the structural integrity of the rafter because the unsupported section can split along the grain of the wood. The joint is generally fastened with nails by toenailing the rafter from the side into the top plate below or using a strap. However, such system has a number of disadvantages, particularly if the indentation is not cut correctly, including 1) the strength of the connection of the roof system to the wall assembly; 2) reduced cross-section of the rafter due to the indentation; and 3) time and skill in cutting the indentation.

Thus, improved connections between studs are rafters are needed.

BRIEF SUMMARY

A rafter bracket configured to connect a vertical post of a building to a rafter of a roof of the building is described herein. The rafter bracket may include lower vertical side plates, a horizontal plate, and upper vertical side plates. Two of the upper vertical side plates and two of the lower vertical side plates may include fastener apertures. The horizontal plate may be perpendicular to the upper and lower vertical side plates, may be attached to the upper vertical side plate bottoms and to the lower vertical side plate tops and may separate the upper vertical side plates from the lower vertical side plates. The horizontal plate and lower vertical side plates may create a generally rectangular cavity that receives the vertical post and fasteners may be positioned through the lower vertical side plate fastener apertures and through the vertical post. Meanwhile, the rafter may be positioned on one of the upper vertical side plates (preferably the lowest of the upper vertical side plates) and positioned between two of the upper vertical side plates (which are preferably opposite each other and include the fastener apertures). The rafter may be angled at an acute angle relative to the vertical post as well as the upper and lower vertical side plates. Preferably, the vertical post and rafter are wood and the vertical post may be a wall stud.

The bracket may include one or more of the following features (and any combination thereof): 1) two of the upper vertical side posts may be opposite one another and perpendicular to another upper vertical side post so that the upper cavity is bounded on three sides; 2) two of the upper vertical side posts opposite each other may include the fastener apertures and may be taller than the other upper vertical side post (which may lack a fastener aperture and may be in the form of a ledge extending above the horizontal plate); 3) the rafter may be positioned on the shortest of the upper vertical side posts; 4) the bracket may be open opposite the shortest upper vertical side posts; 5) the upper vertical side posts may taper in decreasing height from an end adjacent to the shorter upper vertical side post to the open end to mirror the angle of the rafter; 6) the fastener apertures in each of the upper vertical side posts may be offset to mirror the angle of the rafter and the taper and the upper vertical side posts (including fastener apertures) may be mirror images of each other; 7) two of the lower vertical side posts may be opposite one another and perpendicular to two other upper vertical side post so that the lower cavity is bounded on four sides; 8) two of the upper vertical side posts opposite each other may include the fastener apertures and may be taller than the other upper vertical side posts (which may lack a fastener aperture and may be in the form of ledge extending below the horizontal plate); 9) the fastener apertures in the opposite lower vertical side posts may be aligned; 10) bolts, lags, screws or other fasteners may be positioned through the upper vertical side post fastener apertures and through the rafter and additional fasteners may be positioned through the lower vertical side post fastener apertures and the vertical post to secure the rafter and vertical post in place; 11) the distance between the upper vertical side plates with fastener apertures (which may be tapered as described above) may be less than the distance between the lower vertical side plates with fastener apertures to provide stability; 12) the upper vertical side plates with fastener apertures may be perpendicular to the lower vertical side plates with fastener apertures to provide stability; 13) the shortest of the upper vertical side plates may be low enough so that the rafter extends relative to the vertical side plates and vertical post at an angle less than 60 (preferably less than 60 degrees); 14) the rafter may also be positioned on the open end of the bracket opposite the lowest upper vertical side plate; 15) the lower vertical side plates with fastener apertures may each comprise a variable width with a wider portion and a narrower portion and the shorter lower vertical side plates may extend between the wider portions; 16) the shorter upper vertical side plate top may be generally flat as it extends between the taller upper vertical side plates; 17) as shown in the drawings, the vertical post may not touch the rafter when the vertical post and the rafter are positioned in the rafter bracket; 18) the horizontal plate may be generally rectangular in shape and the lower vertical side plates may be spaced about the perimeter of the horizontal plate, whereas the upper vertical side plates may be indented as shown in the drawings; and/or 19) as shown in the drawings, the rafter need not be specially cut at the interface between the rafter and rafter bracket.

Without being bound by any particular theory, it is believed that the rafter bracket may provide a number of advantages including: 1) providing a stronger connection method of the roof system to the wall assembly; 2) allows the rafter to retain greater structural integrity because no birdsmouth joint is made, which by necessity reduces the cross sectional area of the rafter significantly; and 3) facilitates faster and cheaper construction due to the fact that multiple specialty cuts are not required for each rafter.

In some embodiments, the present disclosure provides a rafter bracket configured to connect a vertical post of a building to a rafter of the building, the rafter bracket comprising: a first lower vertical side plate comprising at least one first lower vertical side plate fastener aperture, a first lower vertical side plate top, a first lower vertical side plate bottom, a first lower vertical side plate height extending from the first lower vertical side plate top to the first lower vertical side plate bottom, a first lower vertical side plate first end, a first lower vertical side plate second end opposite the first end, and a first lower vertical side plate width extending from the first lower vertical side plate first end to the first lower vertical side plate second end and generally perpendicular to the first lower vertical side plate height; a second lower vertical side plate opposite the first lower vertical side plate and extending generally parallel to the first lower vertical side plate, the second lower vertical side plate comprising at least one second lower vertical side plate fastener aperture, a second lower vertical side plate top, a second lower vertical side plate bottom, a second lower vertical side plate height extending from the second lower vertical side plate top to the second lower vertical side plate bottom and generally parallel to the first lower vertical side plate height, a second lower vertical side plate first end, a second lower vertical side plate second end opposite the first end, and a second lower vertical side plate width extending from the second lower vertical side plate first end to the second lower vertical side plate second end and generally perpendicular to the first lower vertical side plate height; a third lower vertical side plate extending generally perpendicular to (and preferably extending between) the first and second lower vertical side plates and comprising a third lower vertical side plate top, a third lower vertical side plate bottom, a third lower vertical side plate height extending from the third lower vertical side plate top to the third lower vertical side plate bottom and generally parallel to the first and second lower vertical side plate heights, a third lower vertical side plate proximal end, a third lower vertical side plate distal end, and a third lower vertical side plate length extending from the third lower vertical side plate proximal end to the third lower vertical side plate distal end and generally perpendicular to the first and second lower vertical side plate widths; a fourth lower vertical side plate opposite the third lower vertical side plate, extending generally parallel to the third lower vertical side plate and extending generally perpendicular to (and preferably extending between) the first and second lower vertical side plates, the fourth lower vertical side plate comprising a fourth lower vertical side plate top, a fourth lower vertical side plate bottom, a fourth lower vertical side plate height extending from the fourth lower vertical side plate top to the fourth lower vertical side plate bottom and generally parallel to the first, second and third lower vertical side plate heights, a fourth lower vertical side plate proximal end, a fourth lower vertical side plate distal end, and a fourth lower vertical side plate length extending from the fourth lower vertical side plate proximal end to the fourth lower vertical side plate distal end and generally parallel to the third lower vertical side plate length; a horizontal plate connected to at least one of (and preferably all) the first, second, third and fourth lower vertical side plates (preferably the tops of each), the horizontal plate located above the first, second, third and fourth lower vertical side plate bottoms (and preferably extending from the first lower vertical side plate to the second lower vertical side plate), the horizontal plate extending generally perpendicular to the first, second, third, and fourth lower vertical side plate heights, the horizontal plate comprising a horizontal plate first end, a horizontal plate second end, a horizontal plate width extending from the horizontal plate first end to the horizontal plate second end and generally parallel to the first lower vertical side plate width and second lower vertical side plate width, a horizontal plate proximal end, a horizontal plate distal end, and a horizontal plate length extending from the horizontal plate proximal end to the horizontal plate distal end and generally perpendicular to the horizontal plate width; a lower cavity defined by the first, second, third and fourth lower vertical side plates; a first upper vertical side plate comprising at least one first upper vertical side plate fastener aperture, the first upper vertical side plate having a first upper vertical side plate top located above the first, second, third and fourth lower vertical side plate tops and above the horizontal plate, a first upper vertical side plate bottom (preferably attached to the horizontal plate), a first upper vertical side plate height extending from the first upper vertical side plate top to the first upper vertical side plate bottom and generally parallel to the first and second lower vertical side plate heights, a first upper vertical side plate first end, a first upper vertical side plate second end opposite the first end, and a first upper vertical side plate length extending from the first upper vertical side plate first end to the first upper vertical side plate second end and generally perpendicular to the first upper vertical side plate height; a second upper vertical side plate opposite the first upper vertical side plate and extending generally parallel to the first upper vertical side plate, the second upper vertical side plate comprising at least one second upper vertical side plate fastener aperture, the second upper vertical side plate having a second upper vertical side plate top located above the first, second, third and fourth lower vertical side plate tops and above the horizontal plate, a second upper vertical side plate bottom (preferably attached to the horizontal plate), a second upper vertical side plate height extending from the second upper vertical side plate top to the second upper vertical side plate bottom and generally parallel to the first and second lower vertical side plate heights, a second upper vertical side plate first end, a second upper vertical side plate second end opposite the first end, and a second upper vertical side plate length extending from the second upper vertical side plate first end to the second upper vertical side plate second end and generally perpendicular to the first and second upper vertical side plate height; a third upper vertical side plate extending generally perpendicular to (and preferably extending from) the first and second upper vertical side plates and comprising a third upper vertical side plate top (preferably located above the first, second, third and fourth lower vertical side plate tops) located above the horizontal plate, a third upper vertical side plate bottom (preferably attached to the horizontal plate), a third upper vertical side plate height extending from the third upper vertical side plate top to the third upper vertical side bottom and generally parallel to the first and second lower vertical side plate heights, a third upper vertical side plate first end, a third upper vertical side plate second end opposite the first end, and a third upper vertical side plate length extending from the third upper vertical side plate first end to the third upper vertical side plate second end and generally perpendicular to the first and second upper vertical side plate length; an upper cavity defined by the first upper vertical side plate, second upper vertical side plate, third upper vertical side plate, and horizontal plate; wherein the first lower vertical side plate and second lower vertical side plate are separated a first distance, the first distance substantially constant along the first lower vertical side plate and second lower vertical side plate widths and generally parallel to the horizontal plate length, wherein the first upper vertical side plate and second upper vertical side plate are separated a second distance, the second distance substantially constant along the first upper vertical side plate and second upper vertical side plate lengths, wherein a vertical post of a building is positioned between the first, second, third and fourth lower vertical side plate in the lower cavity, wherein a rafter of the building is positioned on the third upper vertical side plate top and between the first and second upper vertical side plates, wherein at least one upper fastener is positioned through a fastener aperture of the first upper vertical side plate, through the rafter and then through the second upper vertical side plate, and further wherein at least one lower fastener is positioned through a fastener aperture of the first lower vertical side plate, through the vertical post and then through the second lower vertical side plate.

Optionally, the first lower vertical side plate comprises a plurality of first lower vertical side plate fastener apertures, wherein the second lower vertical side plate comprises a plurality of second lower vertical side plate fastener apertures aligned with the first lower vertical side plate fastener apertures, wherein the first upper vertical side plate comprises a plurality of first upper vertical side plate apertures, and further wherein the second upper vertical side plate comprises a plurality of second upper vertical side apertures aligned with the first upper vertical side plate fastener apertures, and further wherein each fastener aperture comprises a fastener. Optionally, the first upper vertical side plate comprises at least two upper vertical side plate fastener apertures adjacent to the first upper vertical side plate first end, wherein the first upper vertical side plate comprises at least two upper vertical side plate fastener apertures adjacent to the first upper vertical side plate second end, wherein the second upper vertical side plate comprises at least two upper vertical side plate fastener apertures adjacent to the second upper vertical side plate first end, wherein the second upper vertical side plate comprises at least two second upper vertical side plate fastener apertures adjacent to the second upper vertical side plate second end, wherein the third upper vertical side plate is adjacent to the first and second upper vertical side plate first ends, wherein at least one first upper vertical side plate fastener aperture adjacent to the first upper vertical side plate first end is above all of the first upper vertical side plate fastener apertures adjacent to the first upper vertical side plate second end, wherein at least one second upper vertical side plate fastener aperture adjacent to the upper vertical side plate first end is above all of the second upper vertical side plate fastener apertures adjacent to the second upper vertical side plate second end, and further wherein the rafter extends upwardly at an acute angle (preferably of less than 60, more preferably less than 45 degrees) relative to the first and second upper vertical side plate heights from the first and second upper vertical side plate second ends to the first and second upper vertical side plate first ends. Optionally, the rafter bracket is open opposite the third upper vertical side plate and further wherein the third upper vertical side plate is adjacent to the first and second upper vertical side plate first ends. Optionally, the first and second upper vertical side plates each comprise a variable height, wherein the first upper vertical side plate tapers in decreasing height from the first upper vertical side plate first end to the first upper vertical side plate second end and further wherein the second upper vertical side plate tapers in decreasing height from the second upper vertical side plate first end to the second upper vertical side plate second end. Optionally, the third upper vertical side plate top is located below the tops of the first and second upper vertical side plate along the entire length of the first and second upper vertical side plates. Optionally, the least two upper vertical side plate fastener apertures adjacent to the first upper vertical side plate first end are aligned in a first vertical row generally parallel to the first upper vertical side plate height, wherein the at least two upper vertical side plate fastener apertures adjacent to the first upper vertical side plate second end are aligned in a second vertical row generally parallel to the first upper vertical side plate height, wherein the at least two upper vertical side plate fastener apertures adjacent to the second upper vertical side plate first end are aligned in a first vertical row generally parallel to the second upper vertical side plate height, and further wherein the at least two second upper vertical side plate fastener apertures adjacent to the second upper vertical side plate second end are aligned in a second vertical row generally parallel to the first upper vertical side plate height. Optionally, the vertical post comprises a vertical post top end located in the lower cavity, a vertical post bottom end, a vertical post height extending from the vertical post top end to the vertical post bottom end and generally parallel to the first and second lower vertical side plate heights and the first and second upper vertical side plate heights, wherein the rafter comprises a rafter first end, a rafter second end, and a rafter length extending from the rafter first end to the rafter second end, and further wherein the rafter length is angled relative to the vertical post height and the first and second upper vertical side plate heights at an angle less than 60 degrees. Optionally, the first and second upper vertical side plates are oriented approximately 90 degrees relative to the first and second lower vertical side plates, and further wherein the third upper vertical side plate is oriented approximately 90 degrees relative to the third and fourth lower vertical side plates. Optionally, the first and second upper vertical side plates are substantially mirror images of each other and further wherein the first and second lower vertical side plates are substantially mirror images of each other. Optionally, the third and fourth lower vertical side plates extend between the first lower vertical side plate and the second lower vertical side plate and the third upper vertical side plate extends between the first upper vertical side plate and the second upper vertical side plate. Optionally, the third and fourth lower vertical side plate heights are less than the first and second lower vertical side plate heights. Optionally, the first and second lower vertical side plate each comprise a variable width with a wider portion and a narrower portion and the third and fourth lower vertical side plates extend between the first and second lower vertical side plate wider portions. Optionally, the third upper vertical side plate top is generally flat as it extends between the first and second upper vertical side plates. Optionally, the lower cavity is generally rectangular in shape. Optionally, the first and second lower vertical side plate tops are attached to the horizontal plate and further wherein the first, second, and third upper vertical side plate bottoms are attached to the horizontal plate. Optionally, the third and fourth lower vertical side plate heights are less than the first and second lower vertical side plate heights and further wherein the third upper vertical side plate height is no more than about ⅓ the median height of the first and second upper vertical side plate. Optionally, the vertical post and the rafter are comprised of wood and the rafter bracket is comprised of metal. Optionally, the vertical post is a wall stud of the building. Optionally, the rafter is also positioned on the horizontal plate. Optionally, the second distance is less than the first distance.

In still further embodiments, the present disclosure provides a rafter bracket configured to connect a vertical post of a building to a rafter of the building, the rafter bracket comprising: a first lower vertical side plate comprising a first lower vertical side plate top, a first lower vertical side plate bottom, a first lower vertical side plate height extending from the first lower vertical side plate top to the first lower vertical side plate bottom, a first lower vertical side plate first end, a first lower vertical side plate second end opposite the first end, and a first lower vertical side plate width extending from the first lower vertical side plate first end to the first lower vertical side plate second end and generally perpendicular to the first lower vertical side plate height; a second lower vertical side plate opposite the first lower vertical side plate and extending generally parallel to the first lower vertical side plate, the second lower vertical side plate comprising a second lower vertical side plate top, a second lower vertical side plate bottom, a second lower vertical side plate height extending from the second lower vertical side plate top to the second lower vertical side plate bottom and generally parallel to the first lower vertical side plate height, a second lower vertical side plate first end, a second lower vertical side plate second end opposite the first end, and a second lower vertical side plate width extending from the second lower vertical side plate first end to the second lower vertical side plate second end and generally perpendicular to the first lower vertical side plate height; a third lower vertical side plate extending generally perpendicular to (and preferably extending between) the first and second lower vertical side plates and comprising a third lower vertical side plate top, a third lower vertical side plate bottom, a third lower vertical side plate height extending from the third lower vertical side plate top to the third lower vertical side plate bottom and generally parallel to the first and second lower vertical side plate heights, a third lower vertical side plate proximal end, a third lower vertical side plate distal end, and a third lower vertical side plate length extending from the third lower vertical side plate proximal end to the third lower vertical side plate distal end and generally perpendicular to the first and second lower vertical side plate widths; a fourth lower vertical side plate opposite the third lower vertical side plate, extending generally parallel to the third lower vertical side plate and extending generally perpendicular to (and preferably extending between) the first and second lower vertical side plates, the fourth lower vertical side plate comprising a fourth lower vertical side plate top, a fourth lower vertical side plate bottom, a fourth lower vertical side plate height extending from the fourth lower vertical side plate top to the fourth lower vertical side plate bottom and generally parallel to the first, second and third lower vertical side plate heights, a fourth lower vertical side plate proximal end, a fourth lower vertical side plate distal end, and a fourth lower vertical side plate length extending from the fourth lower vertical side plate proximal end to the fourth lower vertical side plate distal end and generally parallel to the third lower vertical side plate length; a horizontal plate connected to at least one (and preferably all of) the first, second, third and fourth lower vertical side plates (preferably the tops of each), the horizontal plate located above the first, second, third and fourth lower vertical side plate bottoms (and preferably extending from the first lower vertical side plate to the second lower vertical side plate), the horizontal plate extending generally perpendicular to the first, second, third, and fourth lower vertical side plate heights, the horizontal plate comprising a horizontal plate first end, a horizontal plate second end, a horizontal plate width extending from the horizontal plate first end to the horizontal plate second end and generally parallel to the first lower vertical side plate width and second lower vertical side plate width, a horizontal plate proximal end, a horizontal plate distal end, and a horizontal plate length extending from the horizontal plate proximal end to the horizontal plate distal end and generally perpendicular to the horizontal plate width; a lower cavity defined by the first, second, third and fourth lower vertical side plates; a first upper vertical side plate comprising at least one first upper vertical side plate fastener aperture, the first upper vertical side plate having a first upper vertical side plate top located above the first, second, third and fourth lower vertical side plate tops and above the horizontal plate, a first upper vertical side plate bottom (preferably attached to the horizontal plate), a first upper vertical side plate height extending from the first upper vertical side plate top to the first upper vertical side plate bottom and generally parallel to the first and second lower vertical side plate heights, a first upper vertical side plate first end, a first upper vertical side plate second end opposite the first end, and a first upper vertical side plate length extending from the first upper vertical side plate first end to the first upper vertical side plate second end and generally perpendicular to the first upper vertical side plate height; a second upper vertical side plate opposite the first upper vertical side plate and extending generally parallel to the first upper vertical side plate, the second upper vertical side plate comprising at least one second upper vertical side plate fastener aperture, the second upper vertical side plate having a second upper vertical side plate top located above the first, second, third and fourth lower vertical side plate tops and above the horizontal plate, a second upper vertical side plate bottom (preferably attached to the horizontal plate), a second upper vertical side plate height extending from the second upper vertical side plate top to the second upper vertical side plate bottom and generally parallel to the first and second lower vertical side plate heights, a second upper vertical side plate first end, a second upper vertical side plate second end opposite the first end, and a second upper vertical side plate length extending from the second upper vertical side plate first end to the second upper vertical side plate second end and generally perpendicular to the first and second upper vertical side plate height; a third upper vertical side plate extending generally perpendicular to (and preferably extending from) the first and second upper vertical side plates and comprising a third upper vertical side plate top (preferably located above the first, second, third and fourth lower vertical side plate tops) located above the horizontal plate, a third upper vertical side plate bottom (preferably attached to the horizontal plate), a third upper vertical side plate height extending from the third upper vertical side plate top to the third upper vertical side bottom and generally parallel to the first and second lower vertical side plate heights, a third upper vertical side plate first end, a third upper vertical side plate second end opposite the first end, and a third upper vertical side plate length extending from the third upper vertical side plate first end to the third upper vertical side plate second end and generally perpendicular to the first and second upper vertical side plate length; an upper cavity defined by the first upper vertical side plate, second upper vertical side plate, third upper vertical side plate, and horizontal plate; wherein the first lower vertical side plate and second lower vertical side plate are separated a first distance, the first distance substantially constant along the first lower vertical side plate and second lower vertical side plate widths and generally parallel to the horizontal plate length, wherein the first upper vertical side plate and second upper vertical side plate are separated a second distance, the second distance substantially constant along the first upper vertical side plate and second upper vertical side plate lengths, wherein a vertical post of a building is configured to be positioned between the first, second, third and fourth lower vertical side plate in the lower cavity, wherein a rafter of the building is configured to be positioned on the third upper vertical side plate top and between the first and second upper vertical side plates, wherein the first lower vertical side plate comprises a plurality of first lower vertical side plate fastener apertures, wherein the second lower vertical side plate comprises a plurality of second lower vertical side plate fastener apertures aligned with the first lower vertical side plate fastener apertures, wherein the first upper vertical side plate comprises a plurality of first upper vertical side plate apertures, and further wherein the second upper vertical side plate comprises a plurality of second upper vertical side apertures aligned with the first upper vertical side plate fastener apertures.

Optionally, the first upper vertical side plate comprises at least two upper vertical side plate fastener apertures adjacent to the first upper vertical side plate first end, wherein the first upper vertical side plate comprises at least two upper vertical side plate fastener apertures adjacent to the first upper vertical side plate second end, wherein the second upper vertical side plate comprises at least two upper vertical side plate fastener apertures adjacent to the second upper vertical side plate first end, wherein the second upper vertical side plate comprises at least two second upper vertical side plate fastener apertures adjacent to the second upper vertical side plate second end, wherein the third upper vertical side plate is adjacent to the first and second upper vertical side plate first ends, wherein at least one first upper vertical side plate fastener aperture adjacent to the first upper vertical side plate first end is above all of the first upper vertical side plate fastener apertures adjacent to the first upper vertical side plate second end, wherein at least one second upper vertical side plate fastener aperture adjacent to the second upper vertical side plate first end is above all of the second upper vertical side plate fastener apertures adjacent to the second upper vertical side plate second end, and further wherein the rafter bracket is configured to allow a rafter to extend upwardly at an angle of less than 60 degrees relative to the first and second upper plate heights from the first and second upper vertical side plate second ends to the first and second upper vertical side plate first ends. Optionally, the rafter bracket is open opposite the third upper vertical side plate. Optionally, the first and second upper vertical side plate each comprise a variable height, wherein the first upper vertical side plate tapers in decreasing height from the first upper vertical side plate first end to the first upper vertical side plate second end and further wherein the second upper vertical side plate tapers in decreasing height from the second upper vertical side plate first end to the second upper vertical side plate second end.

BRIEF DESCRIPTION OF THE DRAWINGS

in FIG. 4, the rafter bracket has been rotated as compared to FIG. 3.

in FIG. 5, the rafter bracket has been rotated as compared to FIG. 3.

in FIG. 6, the rafter bracket is in the same orientation as FIG. 5.

in FIG. 7, the rafter bracket is in the same orientation as FIG. 5.

in FIG. 8, the rafter bracket has been rotated 90 degrees as compared to FIG. 5.

in FIG. 9, the rafter bracket is in the same orientation as FIG. 5.

in FIG. 10, the third upper vertical side plate is lower as compared to FIG. 9, which allows the rafter to be placed at a more acute angle.

DETAILED DESCRIPTION

Figure 1:
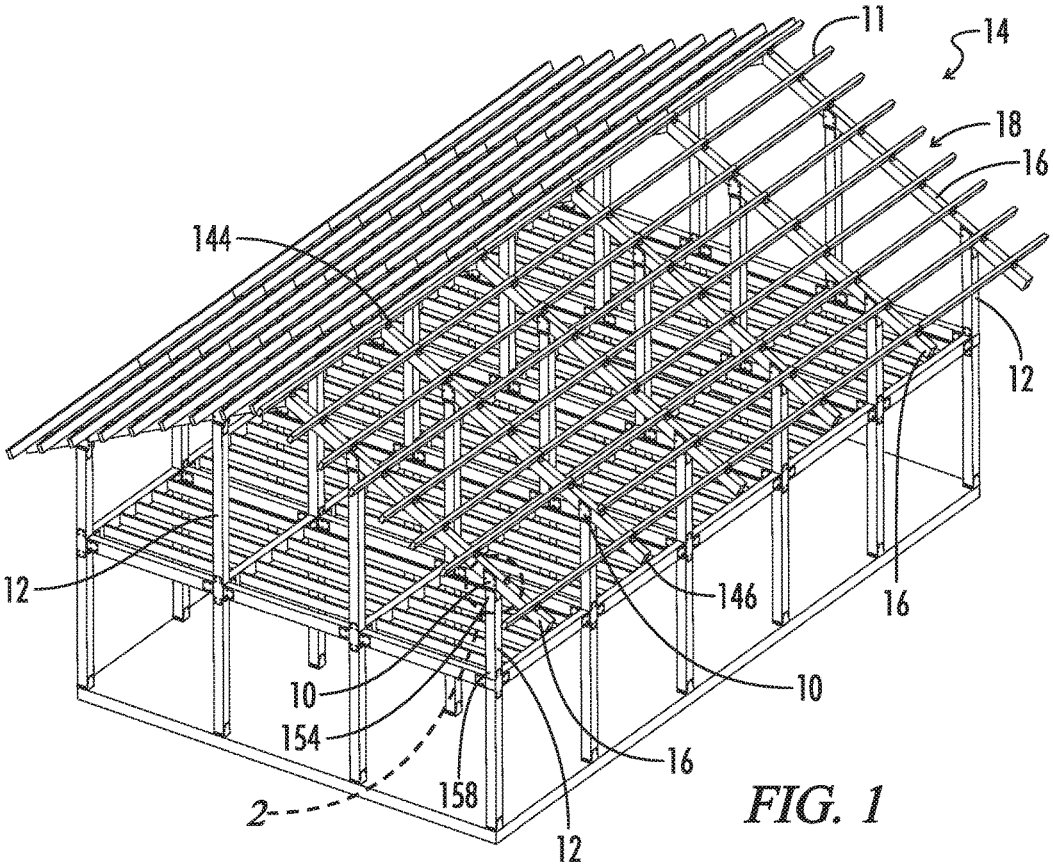
FIG. 1 is a side perspective view of a building utilizing a rafter bracket of one embodiment of the present invention.

With reference to FIGS. 1-10, the present invention provides a rafter bracket generally designated by the numeral 10. In the drawings, not all reference numbers are included in each drawing for the sake of clarity. It will be understood that the above drawings are CAD drawings drawn to scale.

Figure 2:
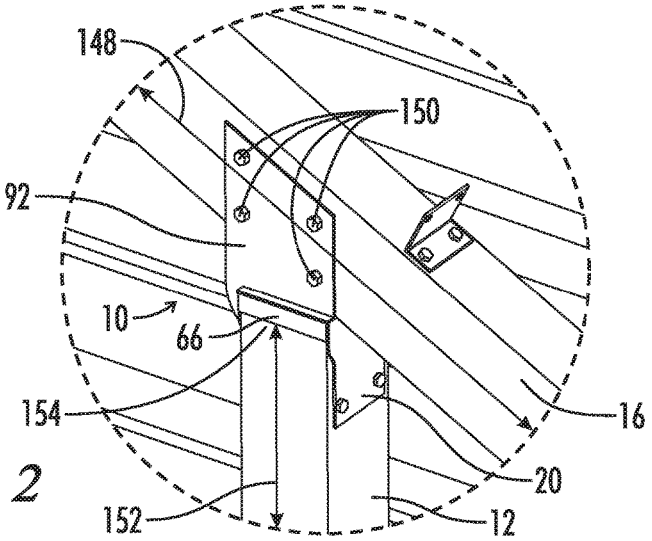
FIG. 2 is a close-up side perspective view of the circled area labelled 2 in FIG. 1 to better show the rafter bracket.
Figure 3:
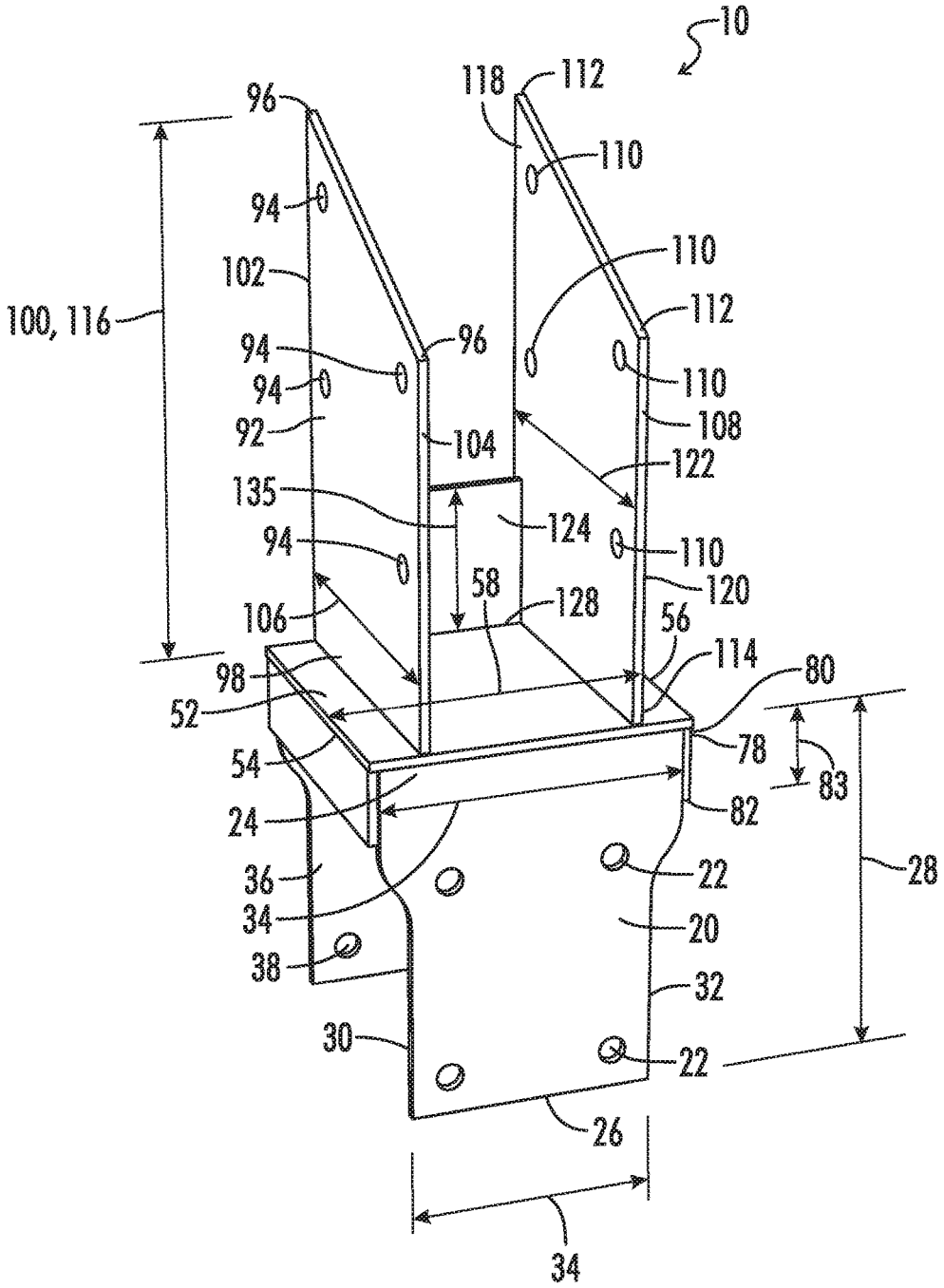
FIG. 3 is a side perspective view of a rafter bracket of another embodiment of the present invention.

As shown in FIGS. 1-10, the rafter bracket 10 may be configured to connect a vertical post 12 of a building 14 to a rafter 16 of the building 14 and may include a first lower vertical side plate 20 comprising at least one first lower vertical side plate fastener aperture/hole 22, a first lower vertical side plate top 24, a first lower vertical side plate bottom 26, a first lower vertical side plate height 28 extending from the first lower vertical side plate top 24 to the first lower vertical side plate bottom 26, a first lower vertical side plate first end 30, a first lower vertical side plate second end 32 opposite the first end 30, and a first lower vertical side plate width 34 extending from the first lower vertical side plate first end 30 to the first lower vertical side plate second end 32 and generally perpendicular to the first lower vertical side plate height 28. As best seen in FIGS. 2-10, the rafter bracket 10 may also include a second lower vertical side plate 36 opposite the first lower vertical side plate 20 and extending generally parallel to the first lower vertical side plate 20, the second lower vertical side plate 36 comprising at least one second lower vertical side plate fastener aperture/hole 38, a second lower vertical side plate top 40, a second lower vertical side plate bottom 42, a second lower vertical side plate height 44 extending from the second lower vertical side plate top 40 to the second lower vertical side plate bottom 42 and generally parallel to the first lower vertical side plate height 28, a second lower vertical side plate first end 46, a second lower vertical side plate second end 48 opposite the first end 46, and a second lower vertical side plate width 50 extending from the second lower vertical side plate first end 46 to the second lower vertical side plate second end 48 and generally perpendicular to the first and second lower vertical side plate heights 28, 44. As best seen in FIGS. 2-10, the rafter bracket 10 may optionally further include a third lower vertical side plate 66 extending generally perpendicular to (and preferably extending between) the first and second lower vertical side plates 20, 36 and comprising a third lower vertical side plate top 68, a third lower vertical side plate bottom 70, a third lower vertical side plate height 71 extending from the third lower vertical side plate top 68 to the third lower vertical side plate bottom 70 and generally parallel to the first and second lower vertical side plate heights 28, 44, a third lower vertical side plate proximal end 72, a third lower vertical side plate distal end 74, and a third lower vertical side plate length 76 that extends from the third lower vertical side plate proximal end 72 to the third lower vertical side plate distal end 74 and is generally perpendicular to the first and second lower vertical side plate widths 34, 50. As best seen in FIGS. 2-10, the rafter bracket 10 may further include a fourth lower vertical side plate 78 opposite the third lower vertical side plate 66, extending generally parallel to the third lower vertical side plate 66 and extending generally perpendicular to (and preferably extending between) the first and second lower vertical side plates 20, 36, the fourth lower vertical side plate 78 comprising a fourth lower vertical side plate top 80, a fourth lower vertical side plate bottom 82, a fourth lower vertical side plate height 83 extending from the fourth lower vertical side plate top 80 to the fourth lower vertical side plate bottom 82 and generally parallel to the first, second and third 71 lower vertical side plate heights 28, 44, 71, a fourth lower vertical side plate proximal end 84, a fourth lower vertical side plate distal end 86, and a fourth lower vertical side plate length 88 extending from the fourth lower vertical side plate proximal end 84 to the fourth lower vertical side plate distal end 86 and generally parallel to the third lower vertical side plate length 76. As best seen in FIGS. 2-10, the rafter bracket 10 may further include a horizontal plate 52 connected to the first, second, third and fourth lower vertical side plate 20, 36, 66, 78 (preferably the tops 24, 40, 68 and 80 of each). As best seen in FIGS. 2-10, the horizontal plate 52 may be located above the first, second, third and fourth lower vertical side plate bottoms 26, 42, 70, 82 (and preferably extends from the first lower vertical side plate 20 to the second lower vertical side plate 36 and from the third lower vertical side plate 66 to the fourth lower vertical side plate 78). As best seen in FIGS. 2-10, the horizontal plate 52 may extend generally perpendicular to the first, second, third, and fourth 83 lower vertical side plate heights 28, 44, 71, 83. As best seen in FIGS. 2-10, the horizontal plate 52 may be generally rectangular in shape and may include a horizontal plate first end 54, a horizontal plate second end 56, a horizontal plate width 58 extending from the horizontal plate first end 54 to the horizontal plate second end 56 and generally parallel to the first lower vertical side plate width 34 and second lower vertical side plate width 50, a horizontal plate proximal end 60, a horizontal plate distal end 62, and a horizontal plate length 64 extending from the horizontal plate proximal end 60 to the horizontal plate distal end 62 and generally perpendicular to the horizontal plate width 58 (and generally parallel to the third and fourth lower vertical side plate lengths 76, 88). As best seen in FIGS. 2-10, the rafter bracket 10 may also include a lower cavity 90 defined by the first, second, third and fourth lower vertical side plates 20, 36, 66, 78 configured to receive the top end 154 of a vertical post 12 (e.g., wall stud 12) of the building 14. In other words, the top end 154 of a generally rectangular vertical post 12 may be surrounded on all four sides by the first, second, third and fourth lower vertical side plates 20, 36, 66, 78, as best seen in FIG. 2. As best seen in FIGS. 2-10, the rafter bracket 10 may also include a first upper vertical side plate 92 comprising at least one first upper vertical side plate fastener aperture/hole 94, the first upper vertical side plate 92 having a first upper vertical side plate top 96 located above the first, second, third and fourth lower vertical side plate tops 24, 40, 68, 80 and above the horizontal plate 52, a first upper vertical side plate bottom 98 (preferably attached to the horizontal plate 52 and also above the first, second, third and fourth lower vertical side plate tops 24, 40, 68, 80), a first upper vertical side plate height 100 extending from the first upper vertical side plate top 96 to the first upper vertical side plate bottom 98 and generally parallel to the first and second lower vertical side plate heights 28, 44, a first upper vertical side plate first end 102, a first upper vertical side plate second end 104 opposite the first upper vertical side plate first end 102, and a first upper vertical side plate length 106 extending from the first upper vertical side plate first end 102 to the first upper vertical side plate second end 104 and generally perpendicular to the first upper vertical side plate height 100. As best seen in FIGS. 2-10, the rafter bracket 10 may also include a second upper vertical side plate 108 opposite the first upper vertical side plate 92 and extending generally parallel to the first upper vertical side plate 92, the second upper vertical side plate 108 comprising at least one second upper vertical side plate fastener aperture/hole 110, the second upper vertical side plate 108 having a second upper vertical side plate top 112 located above the first, second, third and fourth lower vertical side plate tops 24, 40, 68, 80 and above the horizontal plate 52, a second upper vertical side plate bottom 114 (preferably attached to the horizontal plate 52 and above the first, second, third and fourth lower vertical side plate tops 24, 40, 68, 80), a second upper vertical side plate height 116 extending from the second upper vertical side plate top 112 to the second upper vertical side plate bottom 114 and generally parallel to the first and second lower vertical side plate heights 28, 44, a second upper vertical side plate first end 118, a second upper vertical side plate second end 120 opposite the second upper vertical side plate first end 118, and a second upper vertical side plate length 122 extending from the second upper vertical side plate first end 118 to the second upper vertical side plate second end 120 and generally perpendicular to the first and second upper vertical side plate heights 100, 116 (and generally parallel to the first upper vertical side plate length 106). In some embodiments, the first and second upper vertical side plate bottoms 98, 114 extend below the top of the horizontal plate 52 as shown in FIG. 2 to provide more surface area for welding.

As best seen in FIGS. 2-10, the rafter bracket 10 may also optionally include a third upper vertical side plate 124 extending generally perpendicular to (and preferably extending between) the first and second upper vertical side plates 92, 108 and comprising a third upper vertical side plate top 126 (preferably located above the first, second, third and fourth lower vertical side plate tops 24, 40, 68, and 80) located above the horizontal plate 52 and below the first and second upper vertical side plate tops 96, 112 (preferably the tops 96 and 112 along the entire lengths 106 and 122 if the first and second upper vertical side plate tops 96, 112 are tapered), a third upper vertical side plate bottom 128 (preferably attached to the horizontal plate 52), a third upper vertical side plate height 135 extending from the third upper vertical side plate top 126 to the third upper vertical side bottom 128 and generally parallel to the first and second lower vertical side plate heights 28, 44, a third upper vertical side plate first end 130, a third upper vertical side plate second end 132 opposite the first end 130, and a third upper vertical side plate length 134 extending from the third upper vertical side plate first end 130 to the third upper vertical side plate second end 132 and generally perpendicular to the first and second upper vertical side plate lengths 106 and 122. In other words, as best seen in FIGS. 2-10, the third upper vertical side plate top 126 is preferably located below the tops 96, 112 of the first and second upper vertical side plate 92, 108 along the entire length 106, 122 of the first and second upper vertical side plates 92, 108. As best seen in FIGS. 2-10, the rafter bracket 10 may also include an upper cavity 136 defined by the first upper vertical side plate 92, second upper vertical side plate 108, third upper vertical side plate 124, and horizontal plate 52.

Optionally, purlins 11 extend between the rafters 16 and run the length of the building 10.

Preferably the vertical post 12 is located directly below the rafter 16 as shown in FIG. 2.

The first, second, and third upper vertical side plates 92, 108, 124, the horizontal plate 52 and the first, second, third and fourth lower vertical side plates 20, 36, 66, 78 may be discrete metal plates that are welded together. Alternatively, two or more of the first, second, and third upper vertical side plates 92, 108, 124, the horizontal plate 52 and the first, second, third and fourth lower vertical side plates 20, 36, 66, 78 may be integrally attached to each other, in the case of, for example, a rafter bracket 10 that is plastic and made by injection molding. The plates 20, 36, 66, 78, 92, 108, 124 and 52, especially the surfaces of the horizontal plate 52 and the first, second, third and fourth lower vertical side plates 20, 36, 66, 78 that face the vertical post 16 and the surfaces of the first and second upper vertical side plate 92 and 108 that face the rafter 16, are preferably flat so that they can rest against the vertical post 12 and rafter 16, which may be made out of wood.

Figure 4:
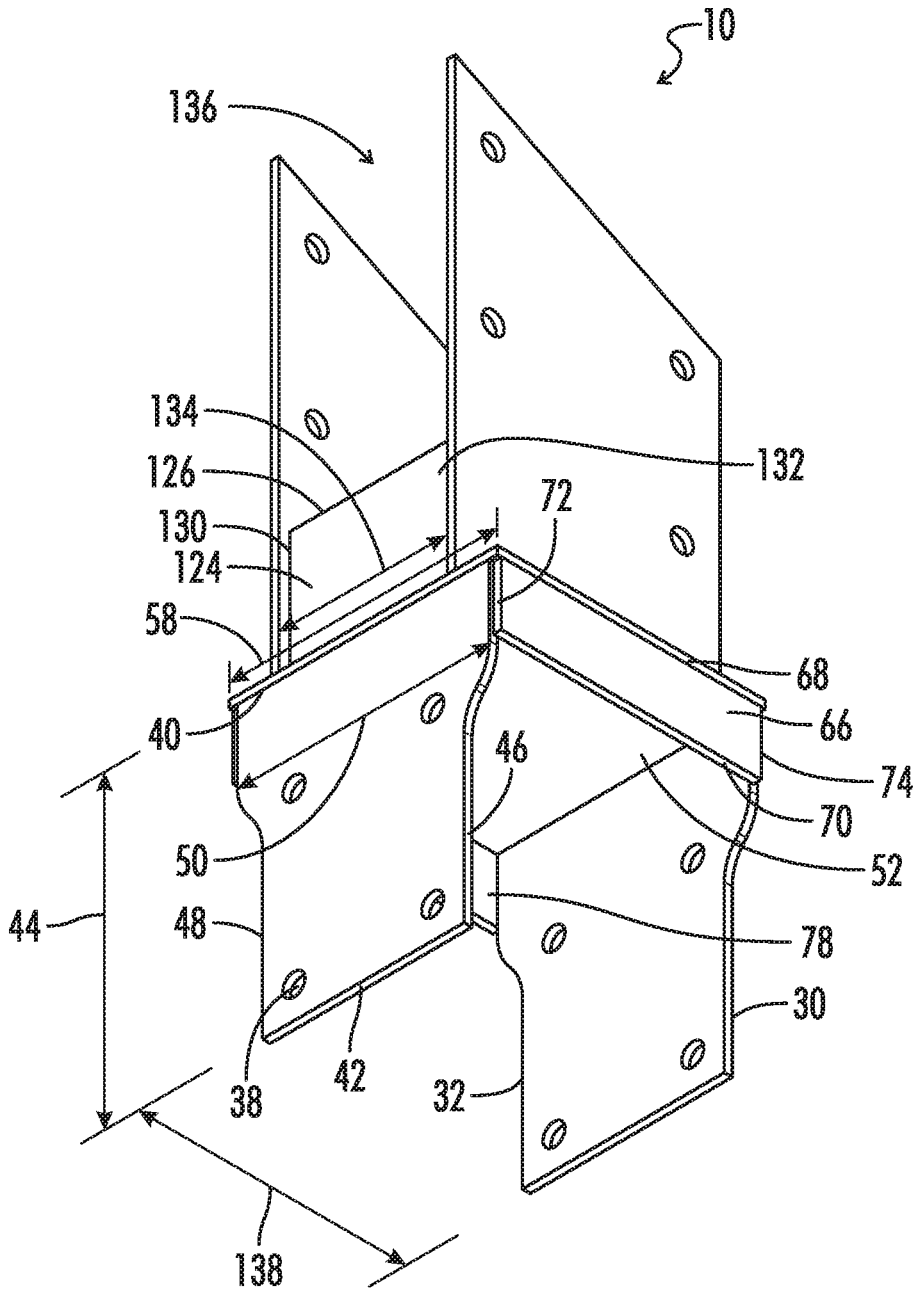
FIG. 4 is a bottom perspective view of the rafter bracket of FIG. 1.
Figure 6:
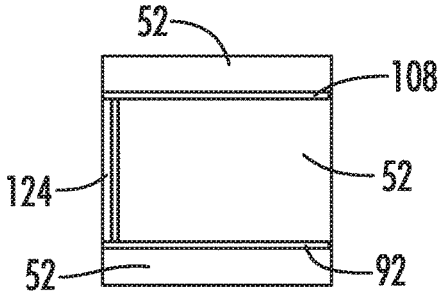
FIG. 6 is a top plan view of the rafter bracket of FIG. 1.
Figure 5:
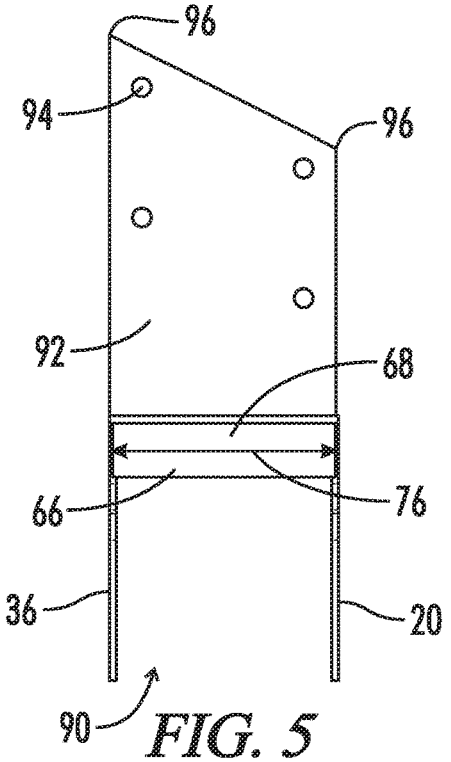
FIG. 5 is a side elevation view of the rafter bracket of FIG. 1.
Figure 8:
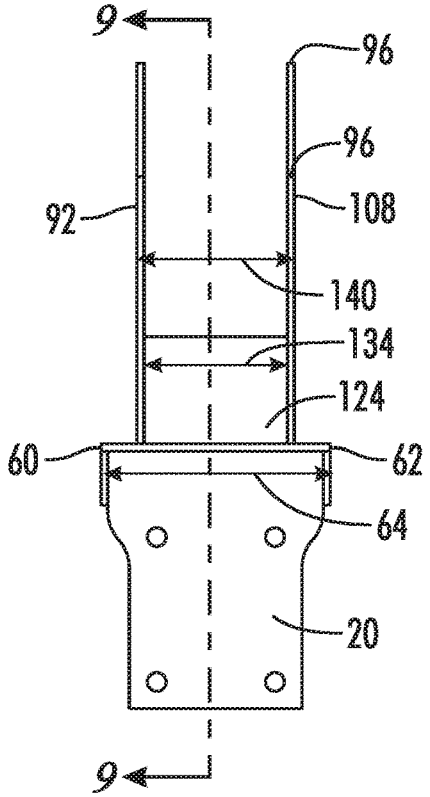
FIG. 8 is a side elevation view of the rafter bracket of FIG. 1.
Figure 7:
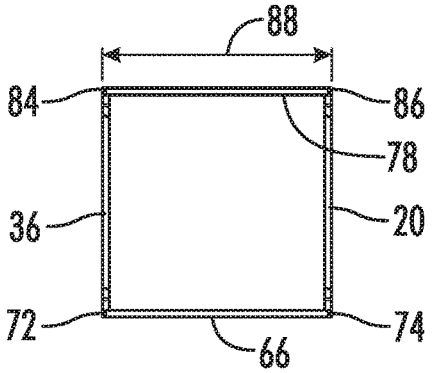
FIG. 7 is a bottom plan view of the rafter bracket of FIG. 1.
Figure 9:
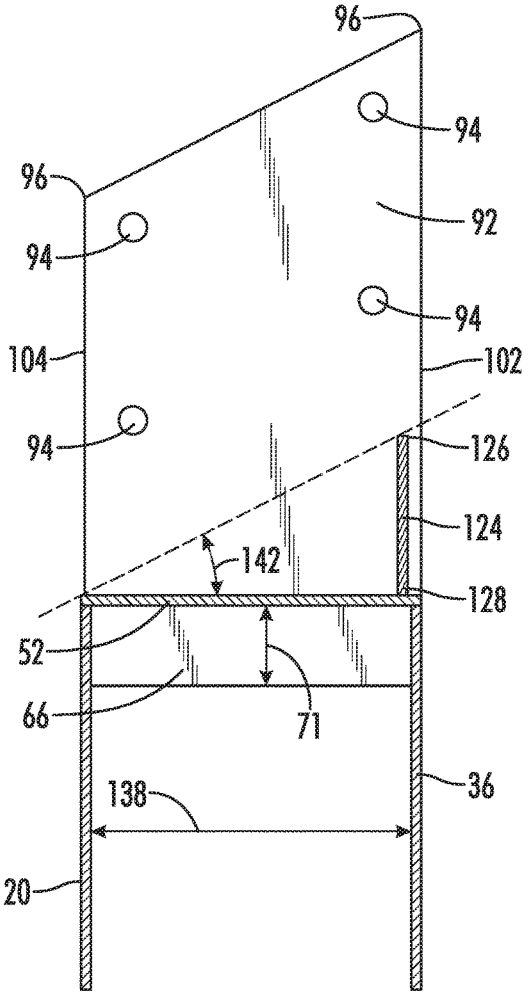
FIG. 9 is a side cross-sectional view of the rafter bracket of FIG. 1.
Figure 10:
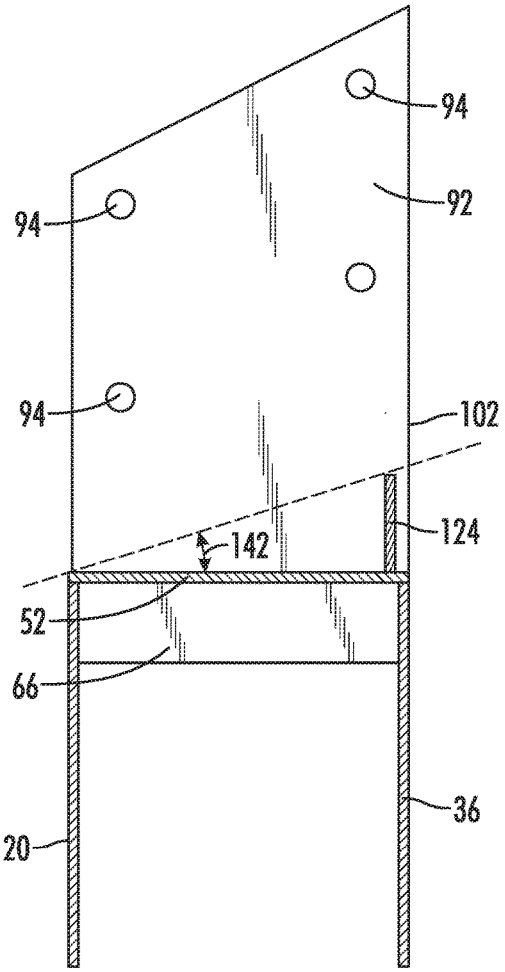
FIG. 10 is a side cross-sectional view of a rafter bracket of another embodiment of the present invention.

Optionally, as labelled in FIG. 4, the first lower vertical side plate 20 and second lower vertical side plate 36 are separated a first distance 138. The first distance 138 may be substantially constant along the first lower vertical side plate 20 and second lower vertical side plate 36 widths 34, 50 and the first distance 138 may be generally parallel to the horizontal plate length 64. Optionally, the first upper vertical side plate 92 and second upper vertical side plate 108 are separated a second distance 140, as labelled in FIG. 8. The second distance 140 may be substantially constant along the first upper vertical side plate 92 and second upper vertical side plate 108 lengths 106, 122 and the second distance 140 may be generally parallel to the horizontal plate width 58. In some but not all embodiments, the second distance 140 is less than the first distance 138. Optionally, as best seen in FIGS. 1 and 2, a vertical post 12 of a building 14 is positioned between the first, second, third and fourth lower vertical side plate 20, 36, 66, 78 in the lower cavity 90 and a rafter 16 of the building 14 is positioned on the third upper vertical side plate top 126 and between the first and second upper vertical side plates 92, 108. Optionally, as best seen in FIG. 2, at least one upper fastener 150 (such as a bolt, screw or lag) is positioned through a fastener aperture/hole 94 of the first upper vertical side plate 92, through the rafter 16 and then through the second upper vertical side plate 108, and at least one lower fastener 150 (such as a bolt, lag or screw) is positioned through a fastener aperture/hole 22 of the first lower vertical side plate 20, through the vertical post 12 and then through the second lower vertical side plate 36. Optionally, as best seen in FIGS. 2-10, the first lower vertical side plate 20 comprises a plurality of first lower vertical side plate fastener apertures/holes 22, the second lower vertical side plate 36 comprises a plurality of second lower vertical side plate fastener apertures/holes 38 aligned with the first lower vertical side plate fastener apertures/holes 22, the first upper vertical side plate 92 comprises a plurality of first upper vertical side plate apertures/holes 94, and the second upper vertical side plate comprises a plurality of second upper vertical side plate apertures/holes 110 aligned with the first upper vertical side plate fastener apertures/holes 94, and, as shown in FIG. 2, each fastener aperture/hole 22, 38, 94, 110 comprises a fastener 150. Optionally, as best seen in FIGS. 2-10, the first upper vertical side plate 92 comprises at least two upper vertical side plate fastener apertures/holes 94 adjacent to the first upper vertical side plate first end 102, the first upper vertical side plate 92 comprises at least two upper vertical side plate fastener apertures/holes 94 adjacent to the first upper vertical side plate second end 104, the second upper vertical side plate 108 comprises at least two upper vertical side plate fastener apertures/holes 110 adjacent to the second upper vertical side plate first end 118, the second upper vertical side plate 108 comprises at least two second upper vertical side plate fastener apertures/holes 110 adjacent to the second upper vertical side plate second end 120, the third upper vertical side plate 124 is adjacent to the first and second upper vertical side plate first ends 102, 118, at least one first upper vertical side plate fastener aperture/hole 94 adjacent to the first upper vertical side plate first end 102 is above all of the first upper vertical side plate fastener apertures/holes 94 adjacent to the first upper vertical side plate second end 105, at least one second upper vertical side plate fastener aperture/hole 110 is above all of the second upper vertical side plate fastener apertures/holes 110 adjacent to the second upper vertical side plate second end 118, and as best seen in FIG. 2, the rafter 16 extends upwardly at an acute angle 142 (preferably of less than 60, more preferably less than 45 degrees) relative to the first and second upper vertical side plate heights 100, 116 from the first and second upper vertical side plate second ends 104, 120 to the first and second upper vertical side plate first ends 102, 118. Optionally, as best seen in FIGS. 2-10, the rafter bracket 10 is open opposite the third upper vertical side plate 124 and the third upper vertical side plate 124 is adjacent to the first and second upper vertical side plate first ends 102, 118. Optionally, as best seen in FIGS. 2-10, the first and second upper vertical side plates 92, 108 each comprise a variable height 100, 116, the first upper vertical side plate 92 tapers in decreasing height from the first upper vertical side plate first end 102 to the first upper vertical side plate second end 104 and the second upper vertical side plate 108 tapers in decreasing height from the second upper vertical side plate first end 118 to the second upper vertical side plate second end 120. Optionally, as shown in FIGS. 2-10, the at least two upper vertical side plate fastener apertures/holes 94, 110 adjacent to the first upper vertical side plate first end 102 are aligned in a first vertical row generally parallel to the first upper vertical side plate height 100, the at least two upper vertical side plate fastener apertures/holes 94, 110 adjacent to the first upper vertical side plate second end 104, are aligned in a second vertical row generally parallel to the first upper vertical side plate height 100, the at least two upper vertical side plate fastener apertures/holes 94, 110 adjacent to the second upper vertical side plate first end 118 are aligned in a first vertical row generally parallel to the second upper vertical side plate height 116, and the at least two second upper vertical side plate fastener apertures/holes 94, 110 adjacent to the second upper vertical side plate second end 120 are aligned in a first vertical row generally parallel to the first upper vertical side plate height 100.

Optionally, the vertical post 12, which may be a wall stud, comprises a vertical post 12 top end 154 located in the lower cavity 90, a vertical post bottom end 158, a vertical post height 152 extending from the vertical post top end 154 to the vertical post bottom end 158 and generally parallel to the first and second lower vertical side plate heights 28, 44 and the first and second upper vertical side plate heights 100, 116, wherein the rafter 16 comprises a rafter first end 144, a rafter second end 146, and a rafter length 148 extending from the rafter first end 144 to the rafter second end 146, and further wherein the rafter length 148 is angled relative to the vertical post height 152 and the first and second upper vertical side plate heights 28, 44 at an angle 142 less than 60 degrees.

Optionally, in some embodiments, as best seen in FIGS. 2-10, the first and second upper vertical side plates 92, 108 are oriented approximately 90 degrees relative to the first and second lower vertical side plates 20, 36, and the third upper vertical side plate 124 is oriented approximately 90 degrees relative to the third and fourth lower vertical side plates 66, 78. In other words, as shown in FIGS. 2-10, the first distance 138 in some embodiments is generally perpendicular to the second distance 140, and the first and second upper vertical side plate lengths 106, 122 are generally perpendicular to the first and second lower vertical side plate widths 34, 50.

Optionally, as best seen in FIGS. 2-10, the first and second upper vertical side plates 90, 108 are substantially mirror images of each other and further wherein the first and second lower vertical side plates 20, 36 are substantially mirror images of each other. In other words, the first and second upper vertical side plates 90, 108 may be substantially the same size and shape and may have the same fastener aperture/hole 94, 110 patterns and the first and second lower vertical side plates 20, 36 may be substantially the same size and shape and may have the same fastener aperture/hole 22, 38 patterns.

Optionally, as best seen in FIGS. 2-10, the third and fourth lower vertical side plates 66, 78 extend between the first lower vertical side plate 20 and the second lower vertical side plate 36, and the third upper vertical side plate 124 extends between the first upper vertical side plate 92 and the second upper vertical side plate 102.

Optionally, as best seen in FIGS. 2-10, the third 66 and fourth 78 lower vertical side plate heights 71, 83 are less than the first and second lower vertical side plate heights 28, 44.

Optionally, as best seen in FIGS. 2-10, the first and second lower vertical side plates 20, 36 each comprise a variable width 34, 50 with a wider portion and a narrower portion and the third and fourth lower vertical side plates 66, 78 extend between the first and second lower vertical side plate 20, 36 wider portions.

Optionally, as best seen in FIGS. 2-10, the third upper vertical side plate top 126 is generally flat as it extends between the first and second upper vertical side plates 92, 108.

Optionally, as best seen in FIGS. 2-10, the lower cavity 90 is generally rectangular in shape.

Optionally, as best seen in FIGS. 2-10, the first and second lower vertical side plate tops 24, 40 are attached to the horizontal plate 52 and further wherein the first, second, and third upper vertical side plate bottoms 98, 114, 128 are attached to the horizontal plate 52. Optionally, as best seen in FIGS. 2-10, the third and fourth lower vertical side plate heights 71, 83 are less than the first and second lower vertical side plate heights 28, 44 (e.g., the third and fourth lower vertical side plate heights 71, 83 may be ⅓ or less of the first and second lower vertical side plate heights 28, 44) and the third upper vertical side plate height 135 is no more than about ⅓ the median height of the first and second upper vertical side plate 92, 108. Thus, as best seen in FIGS. 2-10, the third and fourth lower vertical side plate 66, 78 may be a short ledge that extends below the horizontal plate 52 and the third upper vertical side plate 124 may be a short ledge that extends above the horizontal plate 52.

Optionally, as best seen in FIG. 2, the rafter 16 is also positioned on the horizontal plate 52.

Part List rafter bracket 10
purlin 11
vertical post/stud 12
building 14
rafter 16
roof 18
first lower vertical side plate 20
first lower vertical side plate fastener hole 22
first lower vertical side plate top 24
first lower vertical side plate bottom 26
first lower vertical side plate height 28
first lower vertical side plate first end 30
first lower vertical side plate second end 32
first lower vertical side plate width 34
second lower vertical side plate 36
second lower vertical side plate fastener hole 38
second lower vertical side plate top 40
second lower vertical side plate bottom 42
second lower vertical side plate height 44
second lower vertical side plate first end 46
second lower vertical side plate second end 48
second lower vertical side plate width 50
horizontal plate 52
horizontal plate first end 54
horizontal plate second end 56
horizontal plate width 58
horizontal plate proximal end 60
horizontal plate distal end 62
horizontal plate length 66
third lower vertical side plate 68
third lower vertical side plate bottom 70
third lower vertical side plate height 71
third lower vertical side plate proximal end 72
third lower vertical side plate distal end 74
third lower vertical side plate length 76
fourth lower vertical side plate 78
fourth lower vertical side plate top 80
fourth lower vertical side plate bottom 82
fourth lower vertical side plate height 83
fourth lower vertical side plate proximal end 84
fourth lower vertical side plate distal end 86
fourth lower vertical side plate length 88
lower cavity 90
first upper vertical side plate 92
first upper vertical side plate fastener hole 94
first upper vertical side plate top 96
first upper vertical side plate bottom 98
first upper vertical side plate height 100
first upper vertical side plate first end 102
first upper vertical side plate second end 104
first upper vertical side plate length 106
second upper vertical side plate 108
second upper vertical side plate fastener hole 110
second upper vertical side plate top 112
second upper vertical side plate bottom 114
second upper vertical side plate height 116
second upper vertical side plate first end 118
second upper vertical side plate second end 120
second upper vertical side plate length 122
third upper vertical side plate 124
third upper vertical side plate top 126
third upper vertical side plate bottom 128
third upper vertical side plate first end 130
third upper vertical side plate second end 132
third upper vertical side plate length 134
third upper vertical side plate height 135 upper cavity 136
first distance 138
second distance 140
angle 142
rafter first end 144
rafter second end 146
rafter length 148
fasteners 150
vertical post height 152
vertical post top end 154
vertical post bottom end 158

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A rafter bracket configured to connect a vertical post of a building to a rafter of the building, the rafter bracket comprising:

a first lower vertical side plate comprising at least one first lower vertical side plate fastener aperture, a first lower vertical side plate top, a first lower vertical side plate bottom, a first lower vertical side plate height extending from the first lower vertical side plate top to the first lower vertical side plate bottom, a first lower vertical side plate first end, a first lower vertical side plate second end opposite the first end, and a first lower vertical side plate width extending from the first lower vertical side plate first end to the first lower vertical side plate second end and substantially perpendicular to the first lower vertical side plate height;

a second lower vertical side plate opposite the first lower vertical side plate and extending substantially parallel to the first lower vertical side plate, the second lower vertical side plate comprising at least one second lower vertical side plate fastener aperture, a second lower vertical side plate top, a second lower vertical side plate bottom, a second lower vertical side plate height extending from the second lower vertical side plate top to the second lower vertical side plate bottom and substantially parallel to the first lower vertical side plate height, a second lower vertical side plate first end, a second lower vertical side plate second end opposite the first end, and a second lower vertical side plate width extending from the second lower vertical side plate first end to the second lower vertical side plate second end and substantially perpendicular to the first lower vertical side plate height;

a third lower vertical side plate extending substantially perpendicular to the first and second lower vertical side plates and comprising a third lower vertical side plate top, a third lower vertical side plate bottom, a third lower vertical side plate height extending from the third lower vertical side plate top to the third lower vertical side plate bottom and substantially parallel to the first and second lower vertical side plate heights, a third lower vertical side plate proximal end, a third lower vertical side plate distal end, and a third lower vertical side plate length extending from the third lower vertical side plate proximal end to the third lower vertical side plate distal end and substantially perpendicular to the first and second lower vertical side plate widths;

a fourth lower vertical side plate opposite the third lower vertical side plate, extending substantially parallel to the third lower vertical side plate and extending substantially perpendicular to the first and second lower vertical side plates, the fourth lower vertical side plate comprising a fourth lower vertical side plate top, a fourth lower vertical side plate bottom, a fourth lower vertical side plate height extending from the fourth lower vertical side plate top to the fourth lower vertical side plate bottom and substantially parallel to the first, second and third lower vertical side plate heights, a fourth lower vertical side plate proximal end, a fourth lower vertical side plate distal end, and a fourth lower vertical side plate length extending from the fourth lower vertical side plate proximal end to the fourth lower vertical side plate distal end and substantially parallel to the third lower vertical side plate length;

a horizontal plate connected to at least one of the first, second, third and fourth lower vertical side plates, the horizontal plate located above the first, second, third and fourth lower vertical side plate bottoms, the horizontal plate extending substantially perpendicular to the first, second, third, and fourth lower vertical side plate heights, the horizontal plate comprising a horizontal plate first end, a horizontal plate second end, a horizontal plate width extending from the horizontal plate first end to the horizontal plate second end and substantially parallel to the first lower vertical side plate width and second lower vertical side plate width, a horizontal plate proximal end, a horizontal plate distal end, and a horizontal plate length extending from the horizontal plate proximal end to the horizontal plate distal end and substantially perpendicular to the horizontal plate width;

a lower cavity defined by the first, second, third and fourth lower vertical side plates;

a first upper vertical side plate comprising at least one first upper vertical side plate fastener aperture, the first upper vertical side plate having a first upper vertical side plate top located above the first, second, third and fourth lower vertical side plate tops and above the horizontal plate, a first upper vertical side plate bottom, a first upper vertical side plate height extending from the first upper vertical side plate top to the first upper vertical side plate bottom and substantially parallel to the first and second lower vertical side plate heights, a first upper vertical side plate first end, a first upper vertical side plate second end opposite the first end, and a first upper vertical side plate length extending from the first upper vertical side plate first end to the first upper vertical side plate second end and substantially perpendicular to the first upper vertical side plate height;

a second upper vertical side plate opposite the first upper vertical side plate and extending substantially parallel to the first upper vertical side plate, the second upper vertical side plate comprising at least one second upper vertical side plate fastener aperture, the second upper vertical side plate having a second upper vertical side plate top located above the first, second, third and fourth lower vertical side plate tops and above the horizontal plate, a second upper vertical side plate bottom, a second upper vertical side plate height extending from the second upper vertical side plate top to the second upper vertical side plate bottom and substantially parallel to the first and second lower vertical side plate heights, a second upper vertical side plate first end, a second upper vertical side plate second end opposite the first end, and a second upper vertical side plate length extending from the second upper vertical side plate first end to the second upper vertical side plate second end and substantially perpendicular to the first and second upper vertical side plate height;

a third upper vertical side plate extending substantially perpendicular to the first and second upper vertical side plates and comprising a third upper vertical side plate top located above the horizontal plate, a third upper vertical side plate bottom, a third upper vertical side plate height extending from the third upper vertical side plate top to the third upper vertical side bottom and substantially parallel to the first and second lower vertical side plate heights, a third upper vertical side plate first end, a third upper vertical side plate second end opposite the first end, and a third upper vertical side plate length extending from the third upper vertical side plate first end to the third upper vertical side plate second end and substantially perpendicular to the first and second upper vertical side plate length;

an upper cavity defined by the first upper vertical side plate, second upper vertical side plate, third upper vertical side plate, and horizontal plate;

wherein the first lower vertical side plate and second lower vertical side plate are separated a first distance, the first distance substantially constant along the first lower vertical side plate and second lower vertical side plate widths and substantially parallel to the horizontal plate length, wherein the first upper vertical side plate and second upper vertical side plate are separated a second distance, the second distance substantially constant along the first upper vertical side plate and second upper vertical side plate lengths, wherein the vertical post of the building is positioned between the first, second, third and fourth lower vertical side plate in the lower cavity, wherein the rafter of the building is positioned on the third upper vertical side plate top and between the first and second upper vertical side plates, wherein at least one upper fastener is positioned through a fastener aperture of the first upper vertical side plate, through the rafter and then through the second upper vertical side plate, and further wherein at least one lower fastener is positioned through a fastener aperture of the first lower vertical side plate, through the vertical post and then through the second lower vertical side plate.

2. The rafter bracket of claim 1 wherein the first lower vertical side plate comprises a plurality of first lower vertical side plate fastener apertures, wherein the second lower vertical side plate comprises a plurality of second lower vertical side plate fastener apertures aligned with the first lower vertical side plate fastener apertures, wherein the first upper vertical side plate comprises a plurality of first upper vertical side plate apertures, and further wherein the second upper vertical side plate comprises a plurality of second upper vertical side apertures aligned with the first upper vertical side plate fastener apertures, and further wherein each fastener aperture comprises a fastener.

3. The rafter bracket of claim 2, wherein the first upper vertical side plate comprises at least two upper vertical side plate fastener apertures adjacent to the first upper vertical side plate first end, wherein the first upper vertical side plate comprises at least two upper vertical side plate fastener apertures adjacent to the first upper vertical side plate second end, wherein the second upper vertical side plate comprises at least two upper vertical side plate fastener apertures adjacent to the second upper vertical side plate first end, wherein the second upper vertical side plate comprises at least two second upper vertical side plate fastener apertures adjacent to the second upper vertical side plate second end, wherein the third upper vertical side plate is adjacent to the first and second upper vertical side plate first ends, wherein at least one first upper vertical side plate fastener aperture adjacent to the first upper vertical side plate first end is above all of the first upper vertical side plate fastener apertures adjacent to the first upper vertical side plate second end, wherein at least one second upper vertical side plate fastener aperture adjacent to the second upper vertical side plate first end is above all of the second upper vertical side plate fastener apertures adjacent to the second upper vertical side plate second end, and further wherein the rafter extends upwardly at an acute angle relative to the first and second upper vertical side plate heights from the first and second upper vertical side plate second ends to the first and second upper vertical side plate first ends.

4. The rafter bracket of claim 3 wherein the rafter bracket is open opposite the third upper vertical side plate.

5. The rafter bracket of claim 3 wherein the first and second upper vertical side plates each comprise a variable height, wherein the first upper vertical side plate tapers in decreasing height from the first upper vertical side plate first end to the first upper vertical side plate second end and further wherein the second upper vertical side plate tapers in decreasing height from the second upper vertical side plate first end to the second upper vertical side plate second end.

6. The rafter bracket of claim 5 wherein the third upper vertical side plate top is located below the tops of the first and second upper vertical side plate along the entire length of the first and second upper vertical side plates.

7. The rafter bracket of claim 3 wherein the at least two upper vertical side plate fastener apertures adjacent to the first upper vertical side plate first end are aligned in a first vertical row substantially parallel to the first upper vertical side plate height, wherein the at least two upper vertical side plate fastener apertures adjacent to the first upper vertical side plate second end are aligned in a second vertical row substantially parallel to the first upper vertical side plate height, wherein the at least two upper vertical side plate fastener apertures adjacent to the second upper vertical side plate first end are aligned in a first vertical row substantially parallel to the second upper vertical side plate height, and further wherein the at least two second upper vertical side plate fastener apertures adjacent to the second upper vertical side plate second end are aligned in a second vertical row substantially parallel to the first upper vertical side plate height.

8. The rafter bracket of claim 1 wherein the vertical post comprises a vertical post top end located in the lower cavity, a vertical post bottom end, a vertical post height extending from the vertical post top end to the vertical post bottom end and substantially parallel to the first and second lower vertical side plate heights and the first and second upper vertical side plate heights, wherein the rafter comprises a rafter first end, a rafter second end, and a rafter length extending from the rafter first end to the rafter second end, and further wherein the rafter length is angled relative to the vertical post height and the first and second upper vertical side plate heights at an angle less than 60 degrees.

9. The rafter bracket of claim 1 wherein the first and second upper vertical side plates are oriented approximately 90 degrees relative to the first and second lower vertical side plates, and further wherein the third upper vertical side plate is oriented approximately 90 degrees relative to the third and fourth lower vertical side plates.

10. The rafter bracket of claim 1 wherein the first and second upper vertical side plates are substantially mirror images of each other and further wherein the first and second lower vertical side plates are substantially mirror images of each other.

11. The rafter bracket of claim 1 wherein the third and fourth lower vertical side plates extend between the first lower vertical side plate and the second lower vertical side plate and the third upper vertical side plate extends between the first upper vertical side plate and the second upper vertical side plate.

12. The rafter bracket of claim 11 wherein the third and fourth lower vertical side plate heights are less than the first and second lower vertical side plate heights.

13. The rafter bracket of claim 11 wherein the first and second lower vertical side plate each comprise a variable width with a wider portion and a narrower portion and the third and fourth lower vertical side plates extend between the first and second lower vertical side plate wider portions.

14. The rafter bracket of claim 11 wherein the third upper vertical side plate top is substantially flat as the third upper vertical side plate top extends between the first and second upper vertical side plates.

15. The rafter bracket of claim 1 wherein the lower cavity is substantially rectangular in shape.

16. The rafter bracket of claim 1 wherein the first and second lower vertical side plate tops are attached to the horizontal plate and further wherein the first, second, and third upper vertical side plate bottoms are attached to the horizontal plate.

17. The rafter bracket of claim 1 wherein the third and fourth lower vertical side plate heights are less than the first and second lower vertical side plate heights and further wherein the third upper vertical side plate height is no more than about ⅓ the median height of the first and second upper vertical side plate.

18. The rafter bracket of claim 1 wherein the vertical post and the rafter are comprised of wood and the rafter bracket is comprised of metal.

19. The rafter bracket of claim 18 wherein the vertical post is a wall stud of the building.

20. The rafter bracket of claim 1 wherein the rafter is also positioned on the horizontal plate.

21. The rafter bracket of claim 1 wherein the second distance is less than the first distance.

22. A rafter bracket configured to connect a vertical post of a building to a rafter of the building, the rafter bracket comprising:

a first lower vertical side plate comprising a first lower vertical side plate top, a first lower vertical side plate bottom, a first lower vertical side plate height extending from the first lower vertical side plate top to the first lower vertical side plate bottom, a first lower vertical side plate first end, a first lower vertical side plate second end opposite the first end, and a first lower vertical side plate width extending from the first lower vertical side plate first end to the first lower vertical side plate second end and substantially perpendicular to the first lower vertical side plate height;

a second lower vertical side plate opposite the first lower vertical side plate and extending substantially parallel to the first lower vertical side plate, the second lower vertical side plate comprising a second lower vertical side plate top, a second lower vertical side plate bottom, a second lower vertical side plate height extending from the second lower vertical side plate top to the second lower vertical side plate bottom and substantially parallel to the first lower vertical side plate height, a second lower vertical side plate first end, a second lower vertical side plate second end opposite the first end, and a second lower vertical side plate width extending from the second lower vertical side plate first end to the second lower vertical side plate second end and substantially perpendicular to the first lower vertical side plate height;

a third lower vertical side plate extending substantially perpendicular to the first and second lower vertical side plates and comprising a third lower vertical side plate top, a third lower vertical side plate bottom, a third lower vertical side plate height extending from the third lower vertical side plate top to the third lower vertical side plate bottom and substantially parallel to the first and second lower vertical side plate heights, a third lower vertical side plate proximal end, a third lower vertical side plate distal end, and a third lower vertical side plate length extending from the third lower vertical side plate proximal end to the third lower vertical side plate distal end and substantially perpendicular to the first and second lower vertical side plate widths;

a fourth lower vertical side plate opposite the third lower vertical side plate, extending substantially parallel to the third lower vertical side plate and extending substantially perpendicular to the first and second lower vertical side plates, the fourth lower vertical side plate comprising a fourth lower vertical side plate top, a fourth lower vertical side plate bottom, a fourth lower vertical side plate height extending from the fourth lower vertical side plate top to the fourth lower vertical side plate bottom and substantially parallel to the first, second and third lower vertical side plate heights, a fourth lower vertical side plate proximal end, a fourth lower vertical side plate distal end, and a fourth lower vertical side plate length extending from the fourth lower vertical side plate proximal end to the fourth lower vertical side plate distal end and substantially parallel to the third lower vertical side plate length;

a horizontal plate connected to at least one of the first, second, third and fourth lower vertical side plates, the horizontal plate located above the first, second, third and fourth lower vertical side plate bottoms, the horizontal plate extending substantially perpendicular to the first, second, third, and fourth lower vertical side plate heights, the horizontal plate comprising a horizontal plate first end, a horizontal plate second end, a horizontal plate width extending from the horizontal plate first end to the horizontal plate second end and substantially parallel to the first lower vertical side plate width and second lower vertical side plate width, a horizontal plate proximal end, a horizontal plate distal end, and a horizontal plate length extending from the horizontal plate proximal end to the horizontal plate distal end and substantially perpendicular to the horizontal plate width;

a lower cavity defined by the first, second, third and fourth lower vertical side plates;

a first upper vertical side plate comprising at least one first upper vertical side plate fastener aperture, the first upper vertical side plate having a first upper vertical side plate top located above the first, second, third and fourth lower vertical side plate tops and above the horizontal plate, a first upper vertical side plate bottom, a first upper vertical side plate height extending from the first upper vertical side plate top to the first upper vertical side plate bottom and substantially parallel to the first and second lower vertical side plate heights, a first upper vertical side plate first end, a first upper vertical side plate second end opposite the first end, and a first upper vertical side plate length extending from the first upper vertical side plate first end to the first upper vertical side plate second end and substantially perpendicular to the first upper vertical side plate height;

a second upper vertical side plate opposite the first upper vertical side plate and extending substantially parallel to the first upper vertical side plate, the second upper vertical side plate comprising at least one second upper vertical side plate fastener aperture, the second upper vertical side plate having a second upper vertical side plate top located above the first, second, third and fourth lower vertical side plate tops and above the horizontal plate, a second upper vertical side plate bottom, a second upper vertical side plate height extending from the second upper vertical side plate top to the second upper vertical side plate bottom and substantially parallel to the first and second lower vertical side plate heights, a second upper vertical side plate first end, a second upper vertical side plate second end opposite the first end, and a second upper vertical side plate length extending from the second upper vertical side plate first end to the second upper vertical side plate second end and substantially perpendicular to the first and second upper vertical side plate height;

a third upper vertical side plate extending substantially perpendicular to the first and second upper vertical side plates and comprising a third upper vertical side plate top located above the horizontal plate, a third upper vertical side plate bottom, a third upper vertical side plate height extending from the third upper vertical side plate top to the third upper vertical side bottom and substantially parallel to the first and second lower vertical side plate heights, a third upper vertical side plate first end, a third upper vertical side plate second end opposite the first end, and a third upper vertical side plate length extending from the third upper vertical side plate first end to the third upper vertical side plate second end and substantially perpendicular to the first and second upper vertical side plate length;

an upper cavity defined by the first upper vertical side plate, second upper vertical side plate, third upper vertical side plate, and horizontal plate;

wherein the first lower vertical side plate and second lower vertical side plate are separated a first distance, the first distance substantially constant along the first lower vertical side plate and second lower vertical side plate widths and substantially parallel to the horizontal plate length, wherein the first upper vertical side plate and second upper vertical side plate are separated a second distance, the second distance substantially constant along the first upper vertical side plate and second upper vertical side plate lengths, wherein the vertical post of the building is configured to be positioned between the first, second, third and fourth lower vertical side plate in the lower cavity, wherein the rafter of the building is configured to be positioned on the third upper vertical side plate top and between the first and second upper vertical side plates, wherein the first lower vertical side plate comprises a plurality of first lower vertical side plate fastener apertures, wherein the second lower vertical side plate comprises a plurality of second lower vertical side plate fastener apertures aligned with the first lower vertical side plate fastener apertures, wherein the first upper vertical side plate comprises a plurality of first upper vertical side plate apertures, and further wherein the second upper vertical side plate comprises a plurality of second upper vertical side apertures aligned with the first upper vertical side plate fastener apertures.

23. The rafter bracket of claim 22, wherein the first upper vertical side plate comprises at least two upper vertical side plate fastener apertures adjacent to the first upper vertical side plate first end, wherein the first upper vertical side plate comprises at least two upper vertical side plate fastener apertures adjacent to the first upper vertical side plate second end, wherein the second upper vertical side plate comprises at least two upper vertical side plate fastener apertures adjacent to the second upper vertical side plate first end, wherein the second upper vertical side plate comprises at least two second upper vertical side plate fastener apertures adjacent to the second upper vertical side plate second end, wherein the third upper vertical side plate is adjacent to the first and second upper vertical side plate first ends, wherein at least one first upper vertical side plate fastener aperture adjacent to the first upper vertical side plate first end is above all of the first upper vertical side plate fastener apertures adjacent to the first upper vertical side plate second end, wherein at least one second upper vertical side plate fastener aperture adjacent to the second upper vertical side plate first end is above all of the second upper vertical side plate fastener apertures adjacent to the second upper vertical side plate second end, and further wherein the rafter bracket is configured to allow a rafter to extend upwardly at an angle of less than 60 degrees relative to the first and second upper plate heights from the first and second upper vertical side plate second ends to the first and second upper vertical side plate first ends.

24. The rafter bracket of claim 23 wherein the rafter bracket is open opposite the third upper vertical side plate.

25. The rafter bracket of claim 23 wherein the first and second upper vertical side plate each comprise a variable height, wherein the first upper vertical side plate tapers in decreasing height from the first upper vertical side plate first end to the first upper vertical side plate second end and further wherein the second upper vertical side plate tapers in decreasing height from the second upper vertical side plate first end to the second upper vertical side plate second end.

* * * * *